US008657524B2

(12) United States Patent
Lill

(10) Patent No.: US 8,657,524 B2
(45) Date of Patent: Feb. 25, 2014

(54) ADJUSTABLE RECESSED RESTRICTOR PLATE ASSEMBLY

(75) Inventor: Clifford Lill, Mount Pleasant, SC (US)

(73) Assignee: Campbell-ERS L.L.C., Harrison, NJ (US)

( * ) Notice: Subject to any disclaimer, the term of this patent is extended or adjusted under 35 U.S.C. 154(b) by 0 days.

(21) Appl. No.: 13/517,582

(22) Filed: Jun. 13, 2012

(65) Prior Publication Data

US 2013/0011192 A1 Jan. 10, 2013

Related U.S. Application Data

(60) Provisional application No. 61/496,250, filed on Jun. 13, 2012.

(51) Int. Cl.
*E03F 5/14* (2006.01)

(52) U.S. Cl.
USPC ..... 404/4; 210/163

(58) Field of Classification Search
USPC ..... 210/153, 163, 170.03; 404/2, 3, 4, 5
See application file for complete search history.

(56) References Cited

U.S. PATENT DOCUMENTS

| | | | | |
|---|---|---|---|---|
| 3,863,728 | A * | 2/1975 | Mittendorf | 180/68.6 |
| 6,015,489 | A * | 1/2000 | Allen et al. | 210/131 |
| 7,160,048 | B1 * | 1/2007 | Fattori et al. | 404/4 |
| 7,611,304 | B2 * | 11/2009 | Lill et al. | 404/4 |
| 7,780,372 | B2 * | 8/2010 | Fattori et al. | 404/2 |
| 7,993,072 | B2 * | 8/2011 | Lill | 404/4 |
| 8,235,624 | B2 * | 8/2012 | Lill | 404/4 |
| 2012/0292239 | A1 * | 11/2012 | Lill | 210/163 |
| 2012/0294676 | A1 * | 11/2012 | Lill | 404/4 |

* cited by examiner

*Primary Examiner* — Gary Hartmann

(57) ABSTRACT

Embodiments of a restrictor plate assembly are disclosed that are adapted for being installed into a curb box hood for restricting particulate flow through an inlet mouth of the hood and into a cavity of the hood. An exemplary assembly can include a lengthwise proximate member and a lengthwise distal member which slide lengthwise against each other for increasing a length of the restrictor plate assembly, so that the proximate member can engage a widthwise proximate internal side wall of the hood, and the distal member engages a widthwise distal internal side wall of the hood; thereby securing the restrictor plate assembly within the hood.

32 Claims, 6 Drawing Sheets

ADJUSTABLE RECESSED RESTRICTOR PLATE ASSEMBLY

CROSS-REFERENCE TO RELATED APPLICATION

This patent application claims the benefit of priority to U.S. Provisional Patent Application No. 61/496,250, filed Jun. 13, 2011. The foregoing patent application is incorporated by reference herein in its entirety for any purpose whatsoever.

BACKGROUND OF THE RELATED ART

Storm drain covers are generally known in the art. For example, certain such covers are described in U.S. Pat. No. 7,160,048 to Fattori, et al., for a Flow Restrictor Member, and U.S. Pat. No. 7,128,495, to Lill, et al., for a Curb Box Cover Assembly, both of which are incorporated herein by reference.

SUMMARY OF THE DISCLOSED EMBODIMENTS

The purpose and advantages of the present disclosure will be set forth in and become apparent from the description that follows. Additional advantages of the disclosed embodiments will be realized and attained by the methods and systems particularly pointed out in the written description and claims hereof, as well as from the appended drawings.

To achieve these and other advantages and in accordance with the purpose of the disclosure, as embodied herein, in one aspect, the disclosure includes exemplary embodiments of a restrictor plate assembly that are adapted for being installed into a curb box hood for restricting particulate flow through an inlet mouth of the hood and into a cavity of the hood. The assembly can include, among other things, a lengthwise proximate member and a lengthwise distal member which slide lengthwise against each other for increasing a length of the restrictor plate assembly, so that the proximate member can engage a widthwise proximate internal side wall of the hood, and the distal member can engage a widthwise distal internal side wall of the hood; thereby securing the restrictor plate assembly within the hood.

It is to be understood that both the foregoing general description and the following detailed description are exemplary and are intended to provide further explanation of the disclosed embodiments.

The accompanying drawings, which are incorporated in and constitute part of this specification, are included to illustrate and provide a further understanding of the method and system of the disclosed embodiments. Together with the description, the drawings serve to explain the principles of the disclosed embodiments.

BRIEF DESCRIPTION OF THE FIGURES

Figures are provided, which are not limiting, and in which.

DETAILED DESCRIPTION OF THE DISCLOSED EMBODIMENTS

The disclosed embodiments are those recited in the claims and illustrated in the figures, but such are not limiting. Embodiments of the disclosed restrictor plate are an alternative to a storm drain cover which includes at least one clamp for attaching the storm drain cover to the front surface of a storm drain structure that is, for example, cast iron. In addition, the disclosed restrictor plate assembly is an alternative to a restrictor plate that is attached or intended for attachment without a clamp to the front, street-facing surface of a storm drain structure.

Figure 5:
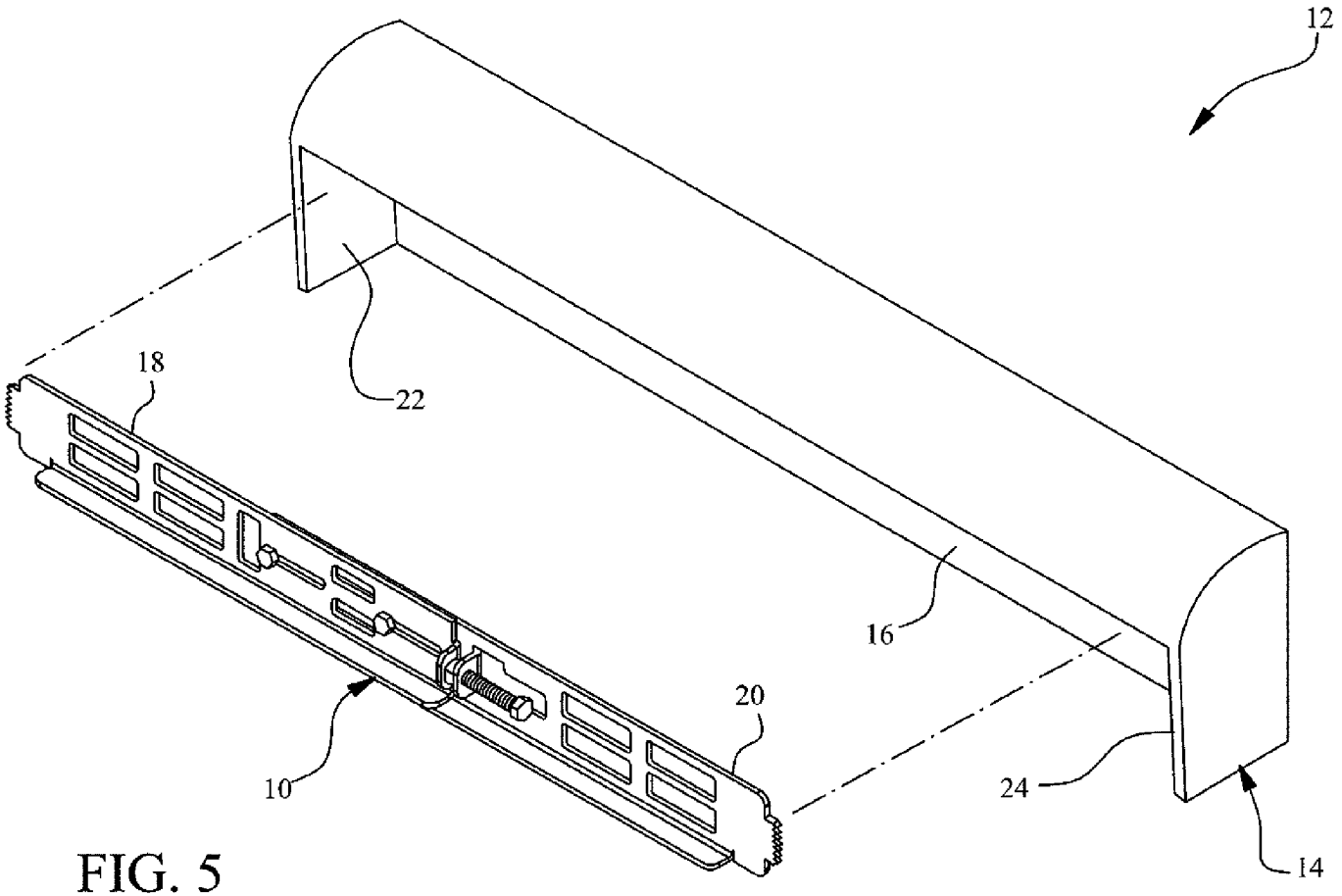
FIG. 5 is a view illustrating placement of the restrictor plate assembly of FIG. 1 in a curb box hood, illustrated in a front perspective view.
Figure 6:
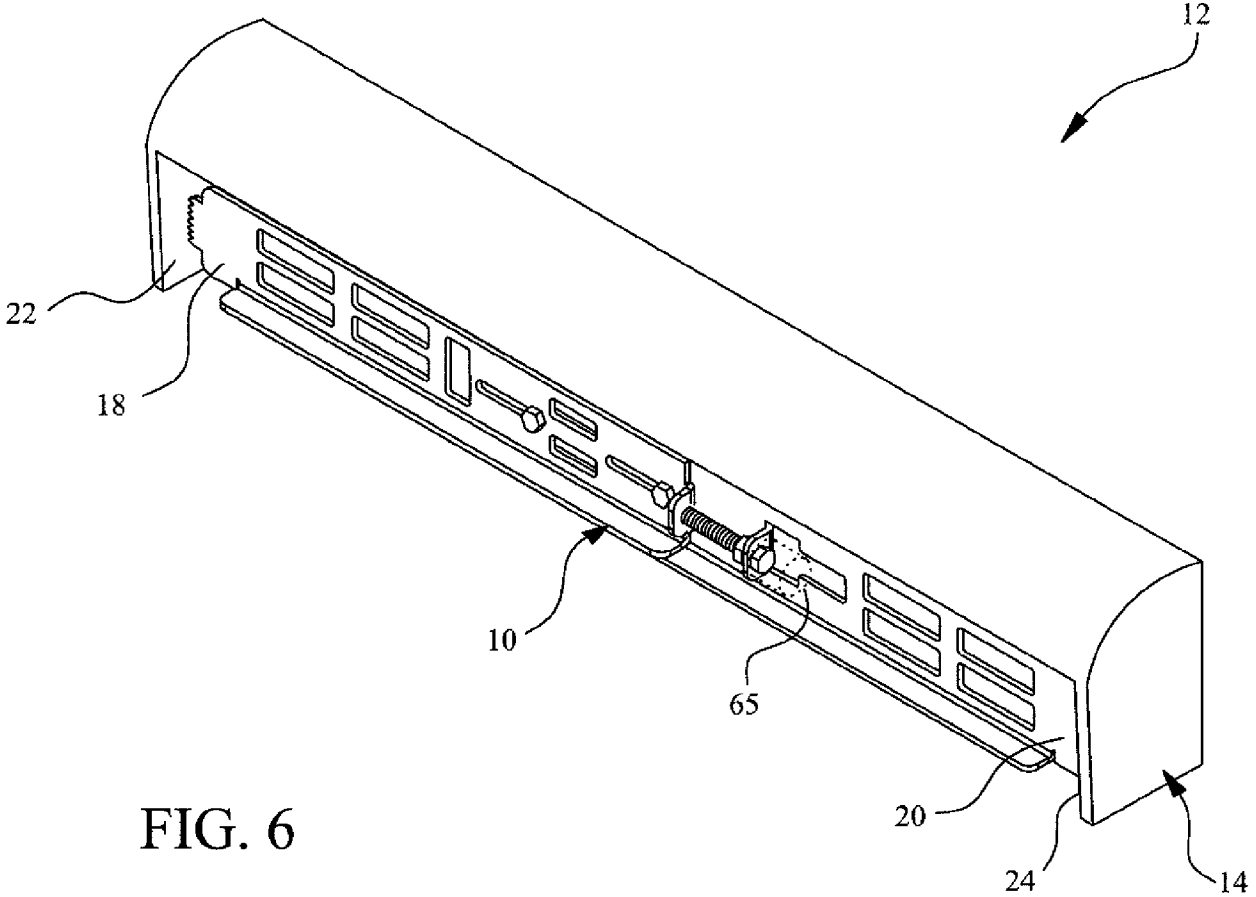
FIG. 6 is another view illustrating the restrictor plate assembly of FIG. 1 disposed in a curb box hood, illustrated in a front perspective view.

For purposes of illustration, and not limitation, one exemplary embodiment, as shown in FIG. 5, illustrates a restrictor plate assembly 10 for being installed into a curb box hood 12 and for restricting particulate flow through an inlet mouth 14 of the hood 12 and into a cavity 16 of the hood 12. As illustrated, the assembly 10 includes a lengthwise proximate member 18 and a lengthwise distal member 20 which slide lengthwise against each other for increasing a length of the restrictor plate assembly 10 so that the proximate member 18 engages a widthwise proximate internal side wall 22 of the hood 12, and the distal member 20 engages a widthwise distal internal side wall 24 of the hood 12, thereby securing the restrictor plate assembly 10 within the hood 12.

Figure 1:
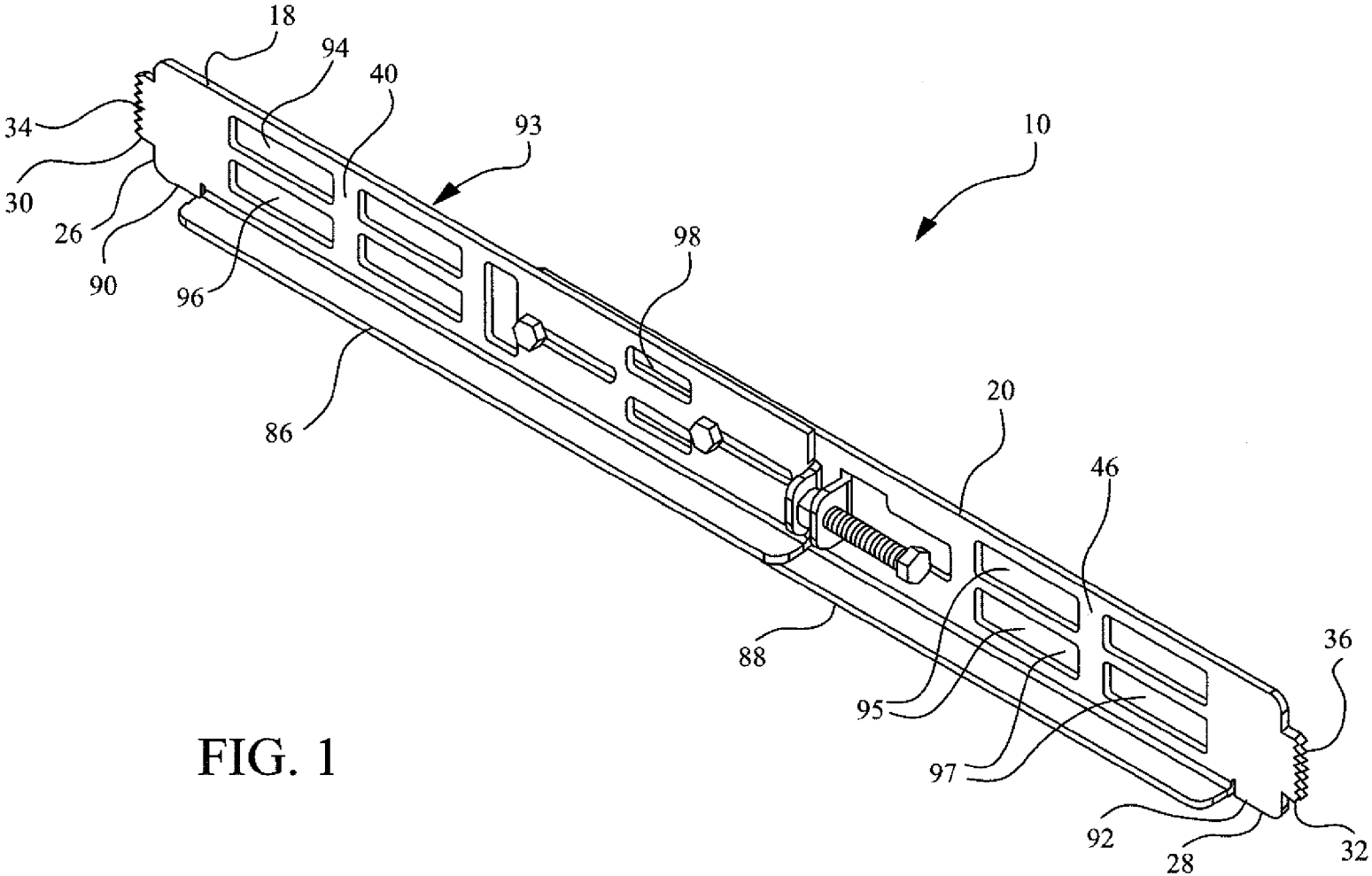
FIG. 1 is a front perspective view of an exemplary restrictor plate assembly in accordance with the disclosure.

In one embodiment of the present disclosure, as shown in FIG. 1, the proximate member 18 has a lengthwise proximate end 26 for engaging the proximate internal side wall 22 of the of the hood 12 when increasing the length of the restrictor plate assembly 10, and the distal member 20 has a lengthwise distal end 28 for engaging the distal internal side wall 24 of the hood 12 when increasing the length of the restrictor plate assembly 10. The lengthwise proximate end 26 of the proximate member 18 includes a lengthwise proximate end tab 30 for engaging the proximate internal side wall 22 of the of the hood 12 when increasing the length of the restrictor plate assembly 10, and the lengthwise distal end 28 of the distal member 20 includes a lengthwise distal tab 32 for engaging the distal internal side wall 24 of the hood 12 when increasing the length of the restrictor plate assembly 10.

The lengthwise proximate end 34 of the proximate tab 30 may include a jagged edge contour 34 for engaging the proximate internal side wall 22 of the hood 12 when increasing the length of the restrictor plate assembly 10, and the lengthwise distal end 36 of the distal tab 32 may include a jagged edge contour 36 for engaging the distal internal side wall 24 of the hood 12 when increasing the length of the restrictor plate assembly 10. The proximate tab 30 can be substantially height-wise centered on the proximate member 18; and the distal tab 52 can be substantially height-wise centered on the distal member 20.

Figure 2:
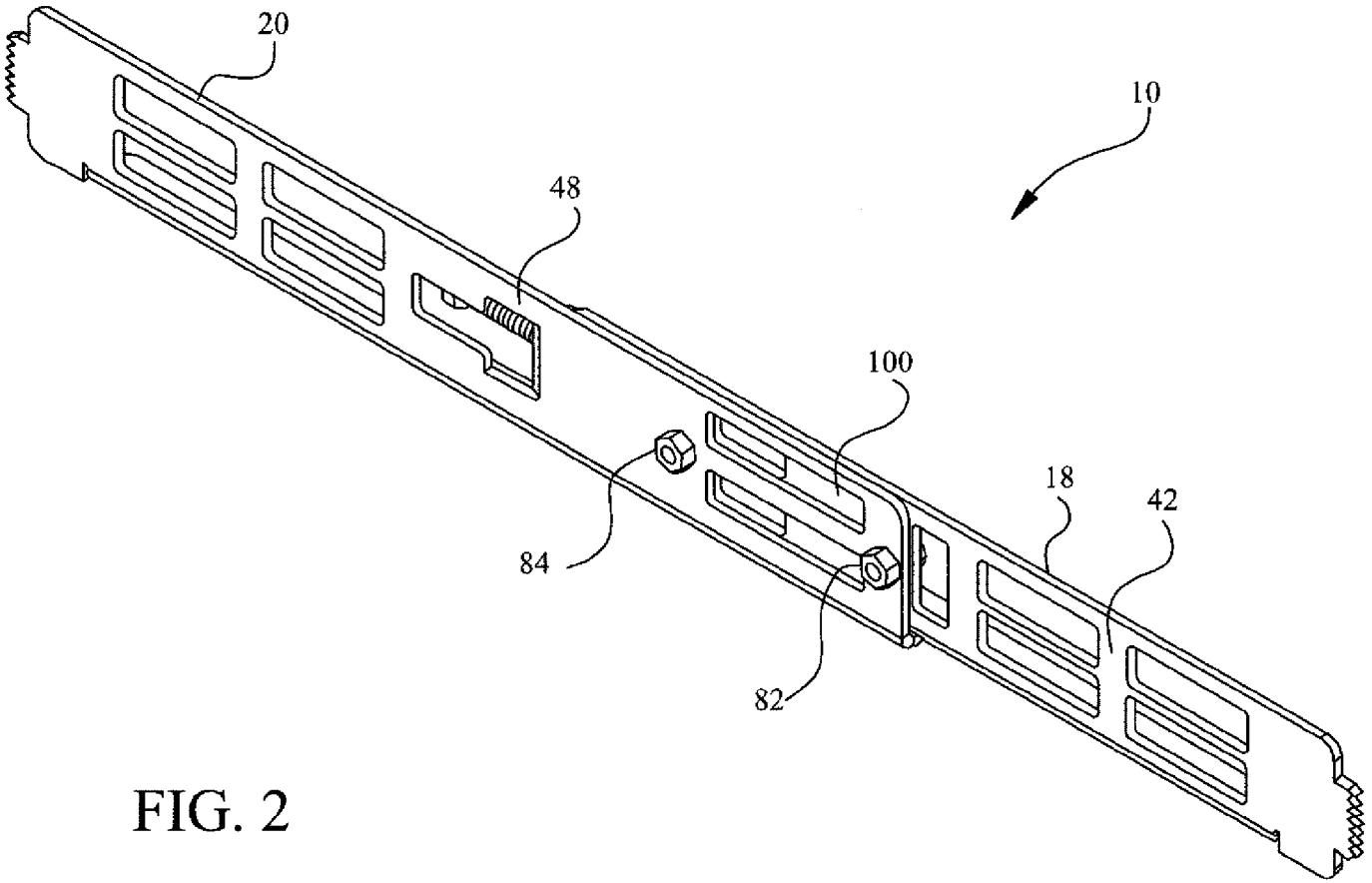
FIG. 2 is a rear perspective view of the restrictor plate assembly of FIG. 1.
Figure 3:
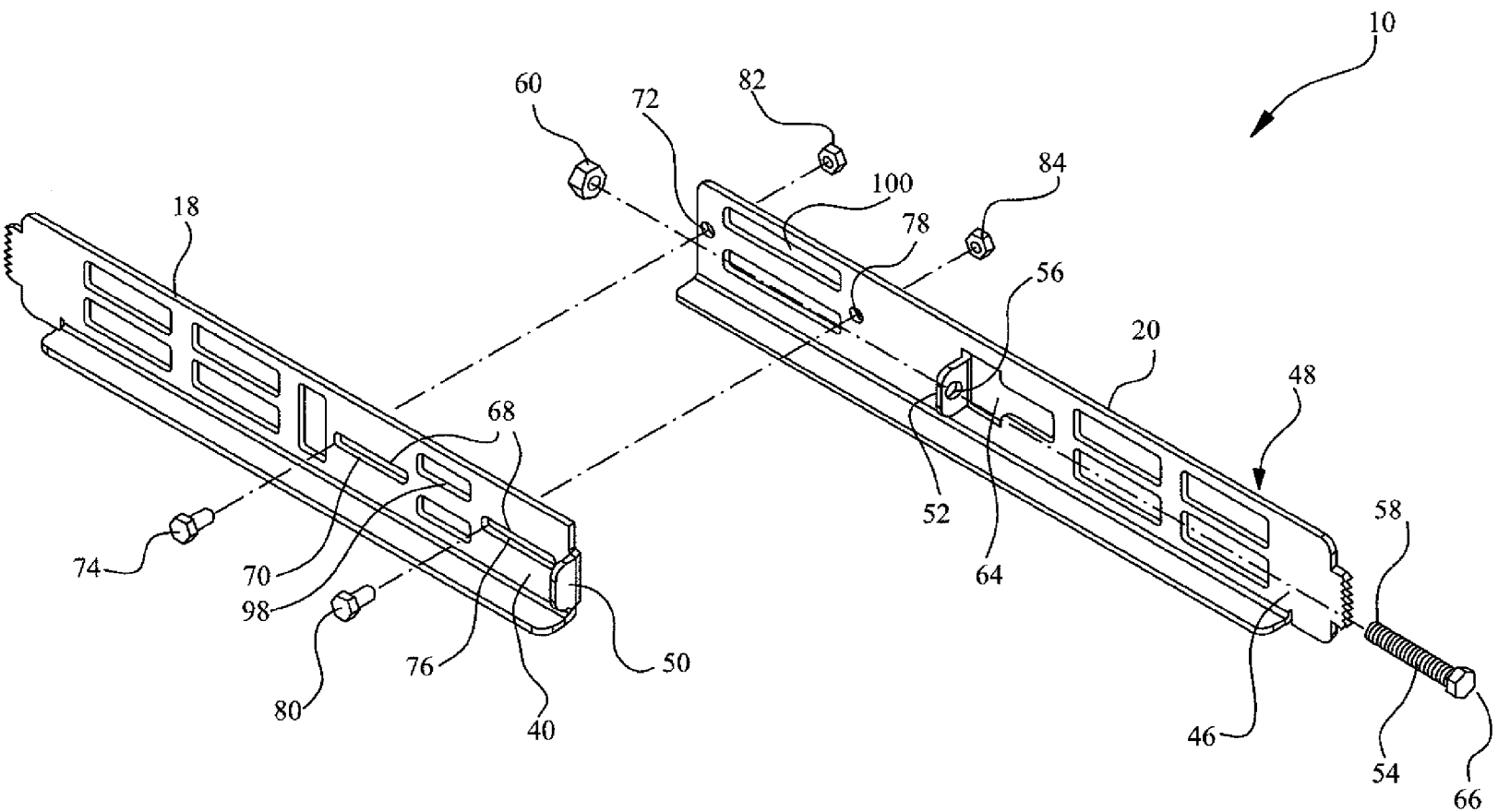
FIG. 3 is an exploded view of the restrictor plate assembly of FIG. 1.
Figure 4:
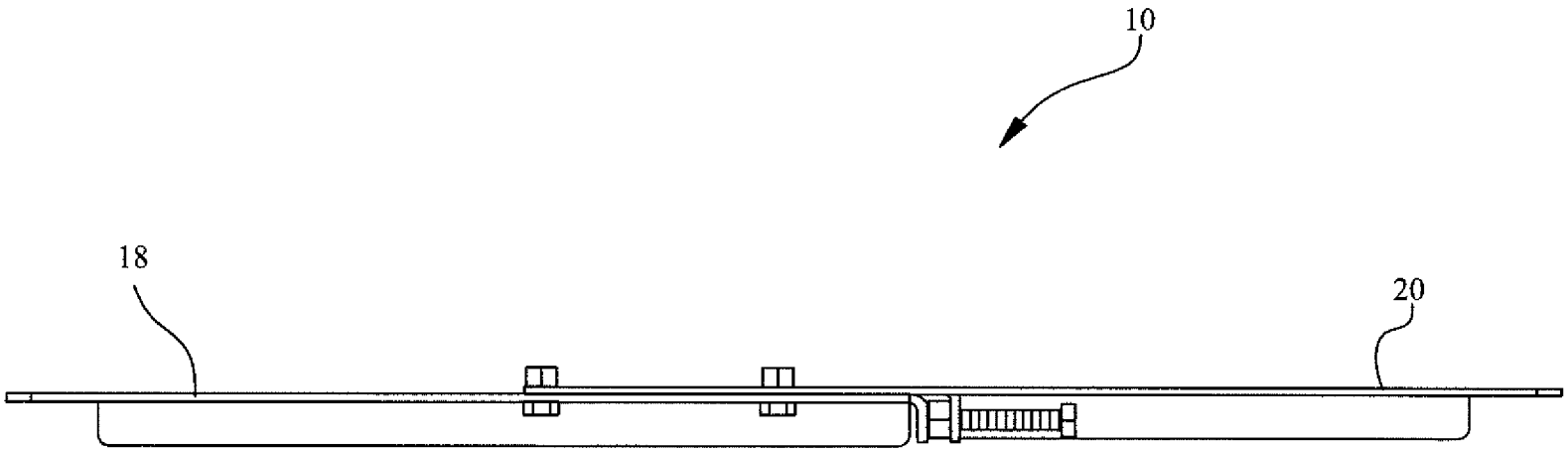
FIG. 4 is a top elevational view of the restrictor plate assembly of FIG. 1.

In an embodiment of the present disclosure, the proximate member 18 can include a proximate forward facing surface 40 and a proximate rearward facing surface 42 (shown in FIG. 2), and the distal member 20 can include a distal forward facing surface 46 and a distal rearward facing surface 48 (shown in FIG. 2), and the rearward facing surface 42 of the proximate member 18 slides against the forward facing surface 46 of the distal member 20 for increasing the length of the restrictor plate assembly 10. As shown in FIG. 3, the proximate member 18 can include a lengthwise distal end tab 50 projecting away from its forward facing surface 40, the distal member 20 includes a lengthwise intermediate tab 52 projecting away from its forward facing surface 46, and an urging member 54 urges the distal end tab 50 and the intermediate tab 52 away from each other so that the proximate member 18 and distal member 20 of the restrictor plate assembly 10 slide away from each other, increasing the length of the restrictor plate assembly 10. The restrictor plate assembly can further include an alignment structure 68 that aligns the proximate member 18 and the distal member 20 when sliding the proximate member 18 against the distal member 20. The proximate member 18 and the distal member 20 can be substantially planar.

The distal end tab 50 preferably extends substantially perpendicularly to the proximate member 18, and may be substantially height-wise centered on the proximate member 18. The intermediate tab 52 preferably extends substantially perpendicularly to the distal member 20, and may be substantially height-wise centered on the distal member 20.

At least one of the proximate member 18 and the distal member 20 may include a strengthening flange 86 extending perpendicularly away from the forward facing surface 40 or 46 or rearward facing surface 42 or 48 thereof. The depth projection of the flange 86 is preferably greater than or equal to that of the distal end tab 50 and the intermediate tab 52.

As illustrated in FIG. 3, the alignment structure can include a first lengthwise extending alignment slot 70 in the proximate member 18, a corresponding first alignment opening 72 in the distal member 20 that is height-wise aligned with the first alignment slot 70, and a first alignment bolt 74 extending therebetween. The alignment structure can further include a second lengthwise extending alignment slot 76 in the proximate member 18 and a corresponding second alignment opening 78 in the distal member 20 that is height-wise aligned with the second alignment slot 76, and a second alignment bolt 80 extending therebetween. The first alignment slot 70 is height-wise centered in the proximate member 18 and the second alignment slot 76 is height-wise aligned with the first alignment slot 70 and lengthwise offset from the first alignment slot 70.

The restrictor plate assembly may further include a first nut 82, which may be connected to the rearward facing surface 48 of the distal member 20 and is concentrically aligned with the first alignment opening 72 for guiding the first alignment bolt 74; and a second nut 84 connected to the rearward facing surface 48 of the distal member 20 and concentrically aligned with the second alignment opening 78 for guiding the second alignment bolt 78. The first and second nuts 82, 84 are preferably lock nuts for locking the restrictor plate assembly 10 in an elongated configuration in the hood 12.

In one embodiment, one of the distal end tab 50 and the intermediate tab 52 has an opening 56 and the urging member 54 is a bolt that extends therethrough, and the bolt 54 has an axial end 58, which is capable of being biased against the other of the distal end tab 50 and the intermediate tab 52 for urging the distal end tab 50 and the intermediate tab 52 away from each other, wherein the proximate member 18 and distal member 20 of the restrictor plate assembly 10 slide away from each other, increasing the length of the restrictor plate assembly 10. As shown in FIGS. 1 and 3, the intermediate tab 52 includes the opening 56 and the axial end 58 of the bolt 54 is an axial proximate end, and the assembly 10 also includes a nut 60 concentrically aligned with the opening 56 for guiding the bolt 54. Bolt 54 and nut 60 preferably both have a straight thread. Bolt 54 may be secured to a proximate side 62 of the intermediate tab 52, for example, it can be welded to the intermediate tab 52.

The distal member 20 may include an opening 64 extending away from the intermediate tab 52 and toward the distal end 28 of the distal member 20. The opening 64 is preferably sized so that the distal member 20 will be substantially free from contact with a socket 65 positioned over a head 66 of the bolt 54 when advancing the axial proximate end of the bolt 58 towards the distal end tab 50 of the proximate member 18.

In an alternative embodiment, the proximate member 18 includes a proximate strengthening flange 86 extending substantially perpendicularly away from one of the forward facing surface 40 or rearward facing surface 42 thereof; and the distal member 20 includes a distal strengthening flange 88 extending substantially perpendicularly away from the corresponding forward facing 46 surface or rearward facing surface 48 thereof. The proximate strengthening flange 86 extends away from a proximate bottom edge 90 of the proximate member 18, and the distal strengthening flange 88 extends away from a distal bottom edge 92 of the distal member 20.

In another embodiment, the restrictor plate assembly 10 includes a bank of openings, including a first filter opening 94 and a second filter opening 96, for filtering particulate above a predetermined size from entering the hood 12. The bank of openings can also include a third filter opening 98 that is an elongated slot in the proximate member 18 and a fourth filter opening 100 that is an elongated slot in the distal member 20 that overlaps with the third filter opening 98 in the assembly. The fourth filter opening 100 can be longer than the third filter opening 98 so that the third filter opening 98 maintains its opening size when the length of the restrictor plate assembly 10 is expanded and contracted. The bank of openings can also include plural openings 95 which are height-wise spaced and plural openings 97 which are widthwise spaced on the restrictor plate assembly 10 so as to form a grid of openings on each of the proximate and distal members 18 and 20.

The present disclosure also provides a combination curb box and restrictor plate where the restrictor plate assembly 10, when lengthwise unextended, has a smaller surface area than the curb box inlet mouth 14 to enable passing therethrough. Further, the restrictor plate assembly can have a height which is substantially the same height as the inlet mouth 14 of the hood 10 to prevent particle flow there-around when installed.

Embodiments of the present disclosure may be manufactured from core-ten steel, among any other suitable materials such as other metals, plastics, composite materials, or combinations thereof.

The methods and systems of the present disclosure, as described above and shown in the drawings, provide for a improved techniques and devices for managing drainage. It will be apparent to those skilled in the art that various modifications and variations can be made in the embodiments of the present disclosure without departing from the spirit or scope of the disclosure. Thus, it is intended that the present disclosure include modifications and variations that are within the scope of the appended claims and their equivalents.

I claim:

1. A restrictor plate assembly for installation into a curb box hood to restrict particulate flow through an inlet mouth into a cavity of the curb box hood; the assembly comprising:

a lengthwise proximate member including a proximate forward facing surface, a proximate rearward facing surface, and a lengthwise distal end tab projecting away from the proximate forward facing surface;

a lengthwise distal member including a distal forward facing surface, a distal rearward facing surface and a lengthwise intermediate tab projecting away from the distal forward facing surface; and an urging member manipulatable to urge the distal end tab and the intermediate tab away from each other, whereby:

the rearward facing surface of the lengthwise proximate member is made to slide lengthwise against the forward facing surface of the lengthwise distal member to increase a length of the restrictor plate assembly until the lengthwise proximate member engages a widthwise proximate internal side wall of the curb box hood and the lengthwise distal member engages a widthwise distal internal side wall of the curb box hood, thereby securing the restrictor plate assembly within the hood.

2. The restrictor plate assembly of claim 1, wherein:

the proximate member has a lengthwise proximate end for engaging the proximate internal side wall of the of the hood when increasing the length of the restrictor plate assembly; and the distal member has a lengthwise distal end for engaging the distal internal side wall of the hood when increasing the length of the restrictor plate assembly.

3. The restrictor plate assembly of claim 2, wherein:

the lengthwise proximate end of the proximate member includes a lengthwise proximate end tab for engaging the proximate internal side wall of the hood when increasing the length of the restrictor plate assembly; and the lengthwise distal end of the distal member includes a lengthwise distal tab for engaging the distal internal side wall of the hood when increasing the length of the restrictor plate assembly.

4. The restrictor plate assembly of claim 3, wherein:

the lengthwise proximate end of the proximate tab includes a jagged edge contour for engaging the proximate internal side wall of the hood when increasing the length of the restrictor plate assembly; and the lengthwise distal end of the distal tab includes a jagged edge contour for engaging the distal internal side wall of the hood when increasing the length of the restrictor plate assembly.

5. The restrictor plate assembly of claim 3, wherein the proximate tab is substantially height-wise centered on the proximate member; and the distal tab is substantially height-wise centered on the distal member.

6. The restrictor plate assembly of claim 1, wherein:

one of the distal end tab and the intermediate tab has an opening and the urging member is a bolt that extends therethrough; and the bolt has an axial end, which is capable of being biased against the other of the distal end tab and the intermediate tab for urging the distal end tab and the intermediate tab away from each other, whereby the proximate member and distal member of the restrictor plate assembly slide away from each other, increasing the length of the restrictor plate assembly.

7. The restrictor plate assembly of claim 6, wherein the intermediate tab includes the opening and the axial end of the bolt is an axial proximate end.

8. The restrictor plate assembly of claim 7, wherein the intermediate tab includes a nut concentrically aligned with the opening for guiding the bolt.

9. The restrictor plate assembly of claim 8, where the bolt and nut both have a straight thread.

10. The restrictor plate assembly of claim 8, wherein the bolt is secured to a proximate side of the intermediate tab.

11. The resistor plate assembly of claim 10, where the bolt is welded to the intermediate tab.

12. The restrictor plate assembly of claim 1, wherein the distal end tab extends substantially perpendicularly to the proximate member; and the intermediate tab extends substantially perpendicularly to the distal member.

13. The restrictor plate assembly of claim 12, wherein the distal end tab is substantially height-wise centered on the proximate member; and the intermediate tab is substantially height-wise centered on the distal member.

14. The restrictor plate assembly of claim 7 wherein:

the distal member includes an opening extending away from the intermediate tab and toward the distal end of the distal member, and the opening is sized so that the distal member will be substantially free from contact with a socket positioned over a head of the bolt when advancing the axial proximate end of the bolt towards the distal end tab of the proximate member.

15. The restrictor plate assembly of claim 1, further comprising an alignment structure that aligns the proximate member and the distal member when sliding the proximate member against the distal member.

16. The restrictor plate assembly of claim 15, wherein the alignment structure includes:

a first lengthwise extending alignment slot in the proximate member, a corresponding first alignment opening in the distal member that is height-wise aligned with the first alignment slot, and a first alignment bolt extending therebetween.

17. The restrictor plate assembly of claim 16, wherein the alignment structure further includes:

a second lengthwise extending alignment slot in the proximate member;

a corresponding second alignment opening in the distal member that is height-wise aligned with the second alignment slot, and a second alignment bolt extending therebetween.

18. The restrictor plate assembly of claim 17, wherein the first alignment slot is height-wise centered in the proximate member and the second alignment slot is height-wise aligned with the first alignment slot and lengthwise offset from the first alignment slot.

19. The restrictor plate assembly of claim 17, further including:

a first nut connected to the rearward facing surface of the distal member and concentrically aligned with the first alignment opening for guiding the first alignment bolt; and a second nut connected to the rearward facing surface of the distal member and concentrically aligned with the second alignment opening for guiding the second alignment bolt.

20. The restrictor plate assembly of claim 19, wherein the first and second nuts are lock nuts for locking the restrictor plate assembly in an elongated configuration in the hood.

21. The restrictor plate assembly of claim 1, wherein the proximate member and the distal member are substantially planar.

22. The restrictor plate assembly of claim 1, wherein at least one of the proximate member and the distal member includes a strengthening flange extending perpendicularly away from the forward facing surfaces or the rearward facing surfaces thereof.

23. The restrictor plate assembly of claim 1, wherein at least one of the proximate member and the distal member includes a strengthening flange extending perpendicularly away from the forward facing surface thereof so that a depth projection of the flange is greater than or equal to that of the distal end tab and the intermediate tab.

24. The restrictor plate assembly of claim 1, wherein:

the proximate member includes a proximate strengthening flange extending substantially perpendicularly away from one of the forward facing surface or the rearward facing surface thereof; and the distal member includes a distal strengthening flange extending substantially perpendicularly away from the corresponding one of the forward facing surface or rearward facing surface thereof.

25. The restrictor plate assembly of claim 24, wherein:

the proximate strengthening flange extends away from the forward facing surface of the proximate member; and the distal strengthening flange extends away from the forward facing surface of the distal member.

26. The restrictor plate assembly of claim 25, wherein:

the proximate strengthening flange extends away from a proximate bottom edge of the forward facing surface of the proximate member; and the distal strengthening flange extends away from a distal bottom edge of the forward facing surface of the distal member.

27. The restrictor plate assembly of claim 1, wherein the restrictor plate assembly includes a bank of openings, including a first filter opening and a second filter opening, for filtering particulates above predetermined size from entering the hood.

28. The restrictor plate assembly of claim 27, wherein the bank of openings includes plural openings which are heightwise spaced and plural openings which are widthwise spaced on the restrictor plate assembly so as to form a grid of openings on each of the proximate and distal members.

29. The restrictor plate assembly of claim 27, wherein:

the bank of openings includes a third filter opening that is an elongated slot in the proximate member and a fourth filter opening that is an elongated slot in the distal member that overlaps with the third filter opening in the assembly; and the fourth filter opening is longer than the third filter opening so that the third filter opening maintains its opening size when expanding and contracting the length of the restrictor plate assembly.

30. A combination curb box and restrictor plate assembly of claim 1, wherein the restrictor plate assembly, when lengthwise unextended, has a smaller surface area than the curb box inlet mouth to enable passing therethrough.

31. The combination of claim 30 wherein the restrictor plate assembly has a height which is substantially the height of the inlet mouth of the hood to prevent particle flow therearound when installed.

32. The restrictor plate assembly of claim 1, manufactured from core-ten steel.

* * * * *